United States Patent [19]

Liebman et al.

[11] 3,958,644

[45] May 25, 1976

[54] PRESSURE SENSITIVE EXPLOSION BARRIER

[75] Inventors: Israel Liebman, Library; John Corry, Elrama; J. Kenneth Richmond, Pittsburgh, all of Pa.

[73] Assignee: The United States of America as represented by the Secretary of the Interior, Washington, D.C.

[22] Filed: July 2, 1975

[21] Appl. No.: 592,488

[52] U.S. Cl. ..... 169/56; 169/64; 169/26

[51] Int. Cl.[2] ..... A62C 3/00

[58] Field of Search ..... 169/51, 58, 56, 60, 169/64, 26, 29

[56] References Cited

UNITED STATES PATENTS

| | | | |
|---|---|---|---|
| 512,927 | 1/1894 | Welker | 169/26 |
| 1,198,535 | 9/1916 | Grasty et al. | 169/64 X |
| 1,261,922 | 4/1918 | Grasty et al. | 169/64 X |
| 3,831,318 | 8/1974 | Richmond | 169/64 |

*Primary Examiner*—John J. Love
*Attorney, Agent, or Firm*—Thomas Zack; Donald R. Fraser

[57] ABSTRACT

A pressure sensitive exposion barrier which is activated by a static pressure rise. A liquid tight housing with a latched door contains the explosive suppression agent, usually water, until activation takes place. Upper hinges on the door allow it to be pivoted outwardly and its agent released. Normally a latch keeps the door locked until the pressure rise from the explosion causes a connected bellows assembly to be depressed. Once depressed, the latch is released and the door is forced outwardly by a biasing member to release the agent before the explosion arrives.

9 Claims, 4 Drawing Figures

PRESSURE SENSITIVE EXPLOSION BARRIER

BACKGROUND OF THE INVENTION

1. Field of the Invention

The invention disclosed herein is an improved explosion suppression device.

2. Description of the Prior Art

In many environments having dangerous gases, the suppression of explosions should be accomplished by devices that are fail proof in operation and do not add to the explosive effect itself. This is particularly true for coal mines and large sanitary sewers where flammable gases can accumulate. One method previously used to suppress an explosion in a coal mine utilized the velocity of the air in front of the explosion to operate a door and release a liquid suppressant from an overhead container. The U.S. Pat. No. 1,000,236 to R. D. Cochrane describes such a system. Our invention is similar in that it uses a contained liquid, like water, to suppress the explosion. Unlike Cochrane, however, its operation depends not on the forward winds from the explosion to activate the release of the suppressant but on static pressure forces caused by the explosion. This is not to say static pressure forces have never been used to actuate the release of an explosive liquid suppressant. They have, as evidenced by the pressure actuated explosive release in the U.S. Pat. No. 2,736,386 J. R. Klompar. The distinction between our invention and the prior art lies not in its actuation medium, per se, but in a combination of facts. Our invention is both rapid in its operation and at the same time adds nothing to the effect of the explosion, as well as being extremely simple and reliable in its operation, and simple in its construction.

SUMMARY OF THE INVENTION

Our explosion suppression device has a closed container with a normally locked and openly biased door and a pressure responsive plate plus a mechanical apparatus for unlocking the door. This apparatus is actuated by a static pressure rise of as little as one pound per square inch increase in the ambient gaseous pressure on the plate whereby said suppressant agent in the container is released.

The primary object of our invention in an improved explosion suppressant device that is actuated by a pressure rise preceding the actual explosion.

Figure 1:
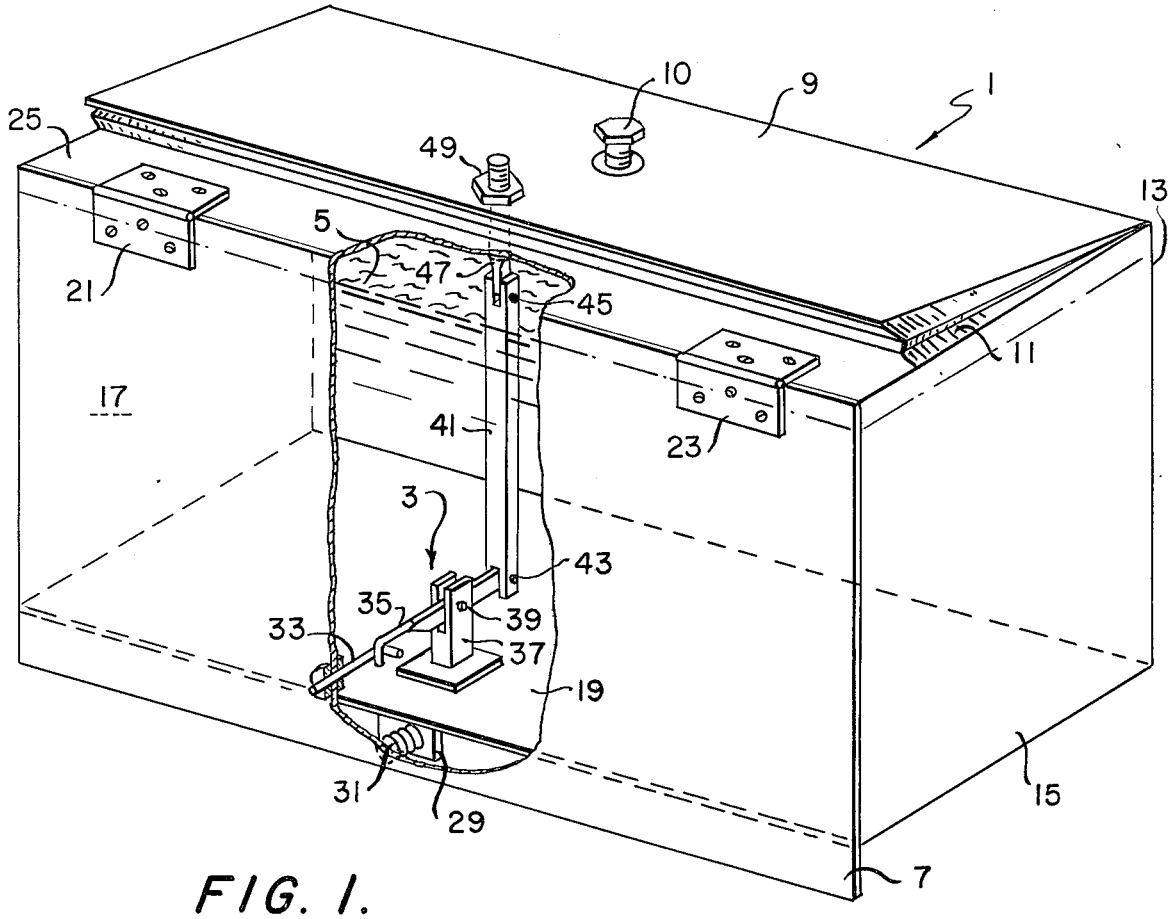
FIG. 1 is a frontal view of the preferred embodiment of our invention with a section cut away to show the actuting mechanism.
Figure 3:
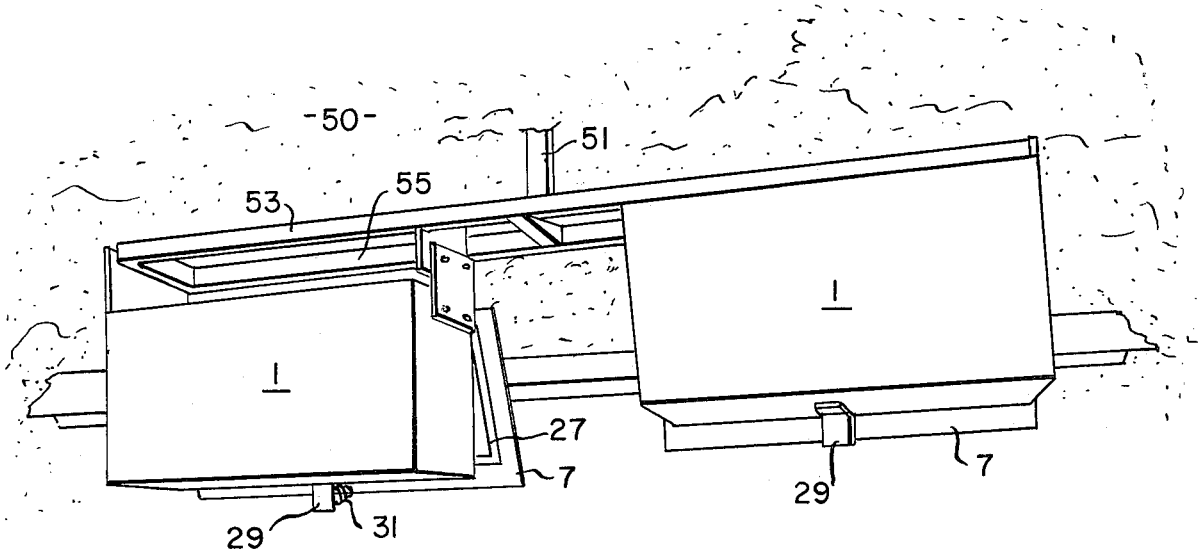
FIG. 3 illustrates two of the preferred embodiments side-by-side in situ in a mine.
Figure 2:
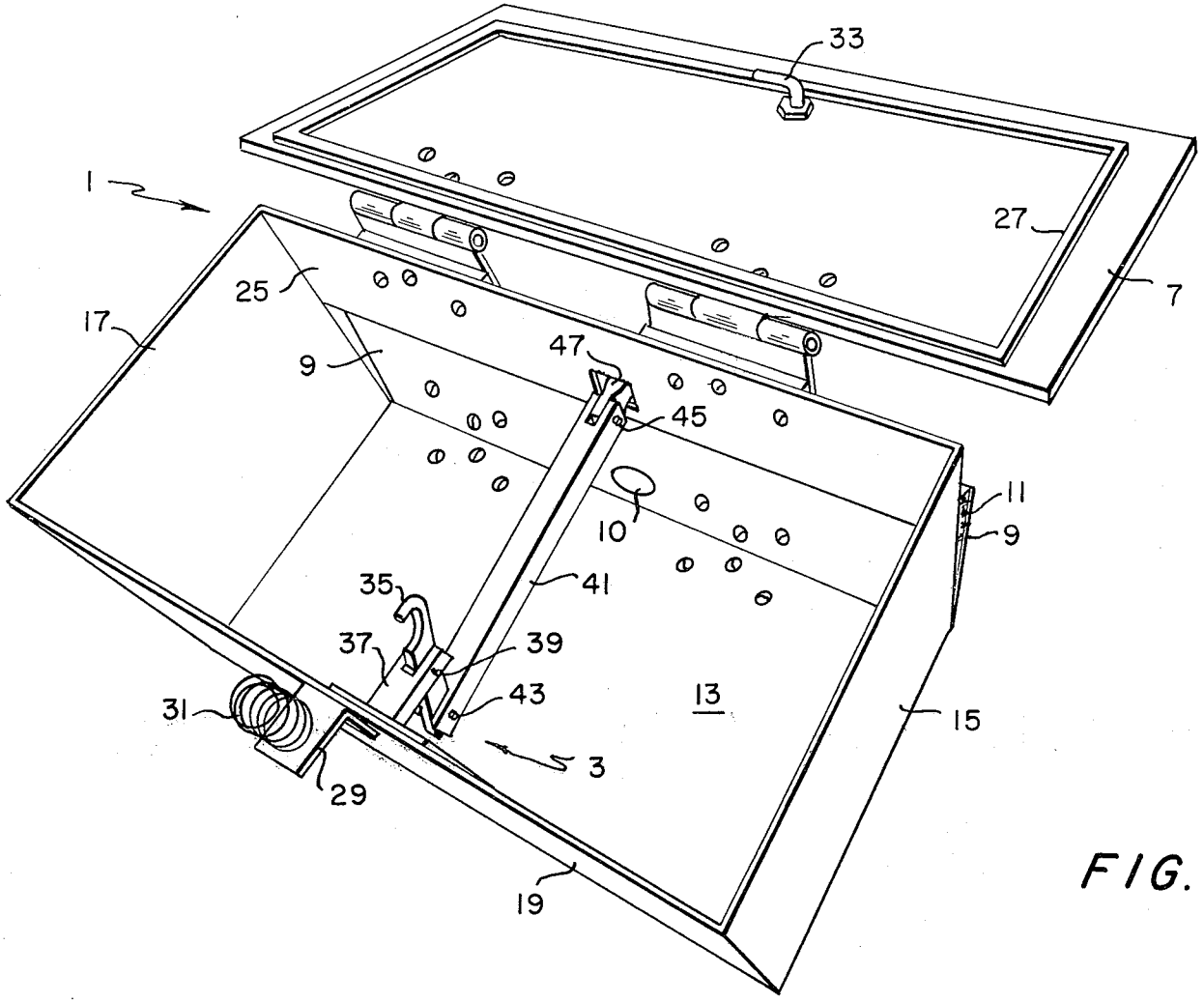
FIG. 2 is a frontal view of the invention with the door opened.

The preferred embodiment of our invention illustrated in FIGS. 1 to 3 has essentially three main components, namely, a container 1 for the suppressant, an actuating mechanism 3, and an explosion suppressant agent 5. The particular construction of the actuating mechanism allows the normally closed and locked door 7 of the container to be opened when there is a static pressure rise of the ambient gases due to an explosion.

The suppressant container is basically a large closed rectangular box with a front door 7, a top rectangular plate 9 with a flexible bellows seal 11 extending around three of its sides at the point where it joins the container's back 13 and its two sides 15 and 17, and a floor 19. The rectangular plate 9 contains a filler plug 10 — used for filling the container with a suppressant. The filler plug contains a small hole to provide a gas leak between the container and ambient atmosphere. The rectangular sides are substantially identical in shape and construction as are the two hinges 21 and 23 used to pivot the door 7 outwardly. These hinges are connected to a front top surface 25 and the door. Although not shown in FIG. 1, there is a second set of hinges (see their retaining nuts in FIG. 2) or pivots connected to the rear of the top plate 9 to allow its pivotal movement relative to the back 13 of the container. A liquid tight seal 27, best shown in FIG. 2, is attached to and extends totally around the interior of the door so that when shut it engages the interior walls of the top, sides, and bottom of the container. Rigidly attached to the appropriate center of the bottom front side of the container floor 19 is a vertical depending extension 29 that retains a outwardly facing and biased compression spring 31. This spring engages the adjacent interior portion of the door, when locked shut, and normally biases the door in an outward opening direction.

The actuating mechanism used to open the container's door has several parts that cooperate to open the door when the static pressure forces rise a small predetermined level. These parts are the hook 33 fastened by a nut and bolt to the door; a swivel clasp 35 which engages the hook end and is pivotted at pivot pin 39 of vertical mount 37 fixed to the floor; and an upright linking shaft 41 connected at one end to the clasp end at pivot pin 43 and at the other end via pivot pin 45 to upper fixed extension 47. A bolt nut-combination 49 at the upper end of extension 47 extends through the top 9 and fixedly holds the extension thereto.

The operation of the preferred embodiment is straight forward. An explosion expanding wave front in a mine coming from the direction shown in FIG. 1 creates a static pressure rise Ps. This increase in pressure causes the container top 9 to move downwardly against the action of the bellows seal. Also moved downward is the extension 47 and shaft 41 causing the clasp 35 to pivot at pins 39 and 43. Because of its prior latching engagement with hook end 33, the upward movement of the free clasp end unlatches the door. Normally outwardly biased spring 31 then forces the door open to release the retained suppressant agent. The container is filled with a liquid extinguishant to a level leaving an air space of about 3 inches from the liquid surface to the roof 25 of the container; this air space is necessary to minimize the internal pressure force generated by the motion of container top 9 which acts to retard the latter's downward movement. The small leak in the filler plug 10 — allows the internal pressure of the container to equilibrate with slow external (atmospheric) pressure changes without effecting the vessel's response to a rapid pressure rise such as developed by an explosion.

A wide variety of liquids — halogen compounds or water-could conceivably be used as the suppressant agent. However, as the immediate problem sought to be solved was the suppression of coal dust explosions, water was selected as the agent. Besides being plentiful, requiring little maintenance, being relatively inexpensive, and not subject to chemical changes when stored for long periods of time, it had the advantage of proven effectiveness as a passive water barrier. In actual experiments about 90 pounds of water in each of two side-by-side containers (see FIG. 3) were effective to put out the flames from an explosion.

As mentioned in the discussion of the prior art, water barriers have previously been used to suppress gaseous explosions in a mine. However, because of the way they were actuated they were either required to be positioned about 160 feet from the explosion initiator in a mine or they required the use of some type of optical or electronic device to sense the explosion and then set off explosives that released the water. What we have done is to not only simplify the construction and reduce the cost of such systems but have created a system whose actuating mechanism — the static pressure rise — is generated by the explosion itself.

Dynamic wind forces preceding a gaseous explosion have been used to actuate water barriers in a mine. However, such barriers fail to operate when the wind speed is too low. In the present invention, static pressure forces rather than dynamic wind forces are used to operate a barrier. This results in a large advantage in useable force, especially for slow moving dust explosion. For example, in a long single mine entry the increase in static pressure developed ahead of an explosion when the pressure rise is less than about 6 psi, is (1) $P_s = pcv$, where $p$ is the gas density in lbs. per cubic ft, $c$ is the velocity of sound in the gas (about 1100 ft/sec) and v is the wind velocity in ft/sec. The corresponding dynamic wind pressure generated ahead of the explosion is (2) $P_d = 1/2pv^2$. The ratio of these two pressures is (3) $P_s/P_d = 2\ c/v$. Equation (3) clearly indicates that $p_s$ is magnitudes larger than Pd for low wind speeds and therefore more effective as the actuating force.

In actual experiments, two side-by-side identical FIG. 1 water containers or barriers were suspended from the roof 50 of a coal mine as shown in FIG. 3. A vertical center support 51 was firmly embedded into the mine roof. Parallel horizontal connecting supports 53 in turn suspended the barriers. Except for the aluminum hinged doors facing away from the direction of the explosion all supports and parts of the container were made of steel. The 2 feet long by 1 foot wide by 1 foot high barriers were each filled with 90 pounds of water. In two explosion tests - summary shown in the following table — coal dust explosions were initiated 105 ft from the barrier. The doors of the barrier opened to discharge the water when the static pressure rose to about 1 psi at which time the flame had propagated about 50 feet from the ignition source. The flame speed at the barrier site, prior to being extinguished, was less than 100 ft./sec. in both tests.

These tests show that low speed dust explosions propagating at speeds of approximately 100 feet/second can be suppressed by barriers which operate by a static pressure rise. Previously, when the dynamic wind pressures were used as the actuating mechanism wind speeds of 250 feet/second or more were required. Our invention can operate effectively at explosive flame speeds less than 100 feet/second and therefor can suppress slow moving dust explosions. In addition, our invention allows the barriers to be placed less than 100 feet from the explosion initiator source whereas most present water barriers operated by wind velocity are effective only when placed 170 feet or more from the source. This shortened distance has the evident advantage of confining the extent and damage from the explosion. It is anticipated that our invention will be able to operate when a 1 psi pulse is suddenly applied in about 50 milliseconds. When the pressure slowly increases so that it takes several seconds to reach 1 psi, the unit will also respond dependent on such factors as the size of the filler plug leak between the container and the outside atmosphere.

Figure 4:
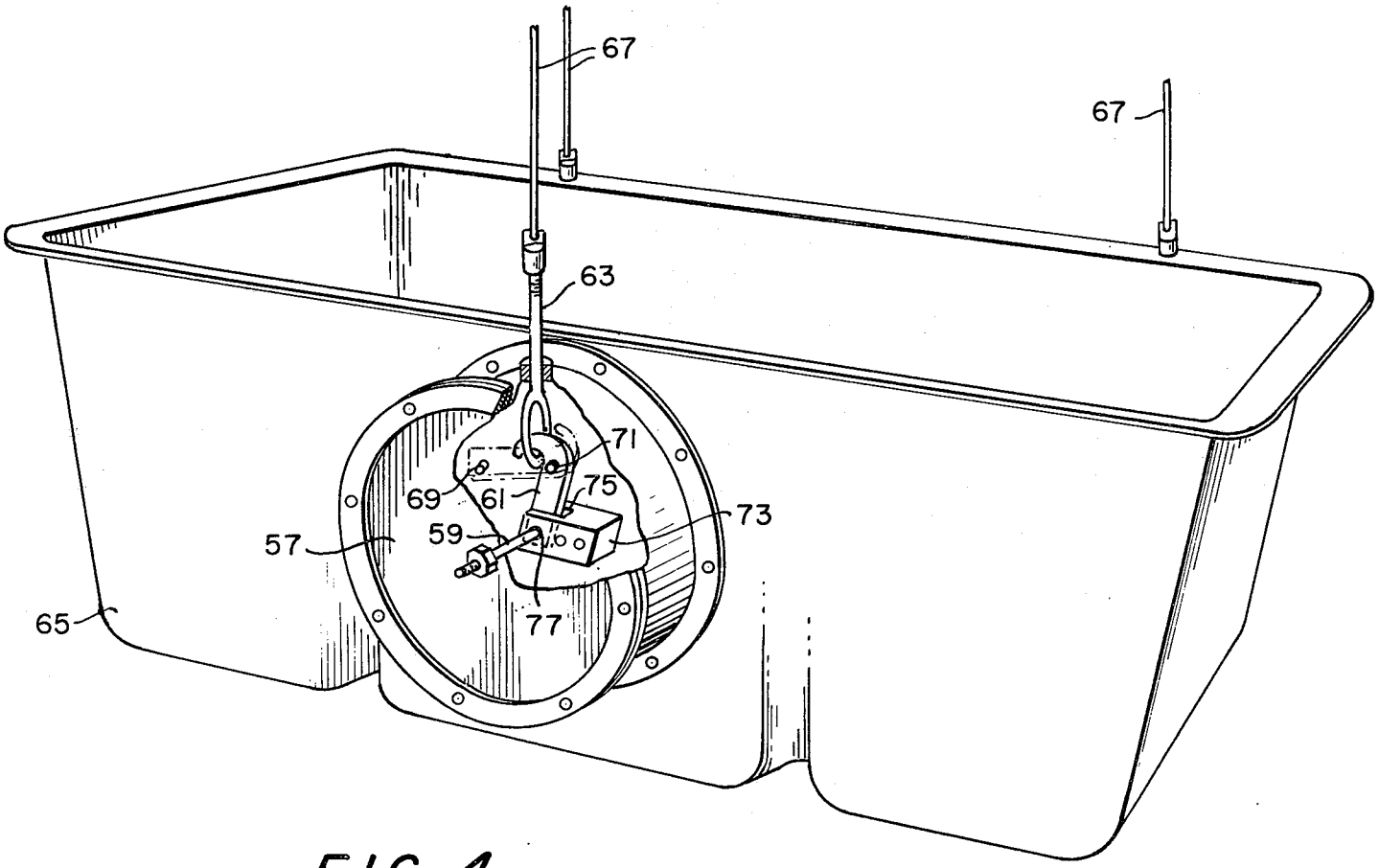
FIG. 4 is a different embodiment of the FIG. 1 suppression device.

Besides the disclosed preferred embodiment used to actuate the opening of the liquid suppressant container other types of mechanisms may also be used. In one type, a pressure sensitive diaphragm with a rod connected to its center is employed. When the static pressure rise from the explosion is great enough, the diaphragm is pushed inwardly to move its center rod which then releases a swivel clasp normally held to a fixed wire hook in the roof. The clasp release allows a suppressant holding container to pivot downwardly on two wires holding it to thereby discharge its contents. FIG. 4 illustrates this additional embodiment using a pressure sensitive diaphragm 57 having an attached center pin rod 59. Three vertical wires 67 normally holding the open tub 65 are attached to the mine roof in the tripod type arrangement shown with one front wire hold the end of the depending eye hook 63. Block 73 is fixed to the tub and moves therewith.

When rod 59 is moved inwardly its front end engages the end of a spring loaded retaining pin 69 fixed at one end to block 73 and normally extending through hole 77 of this block. Once the pin 69 is depressed a sufficient distance, swivel clasp 61 pivots on its pin 71, due to the force of gravity, to allow the clasp to move from block groove 75 to the dotted line position shown. This releases the support provided by the hook 63 to allow the tub to pivot on the two back wires 67 and release its liquid suppressant contents to quench the fire. When this happens, hook 63 and clasp 61 remain suspended to the ceiling.

None of the disclosed details of the embodiments disclosed should be used to measure the scope and

| | Location of Barrier from ignition, ft. | Static Pressure when doors open, p.s.i.g. | Location of Flame from ignition when doors open, ft. |
|---|---|---|---|
| Test 1 | 105 | 1.0 | 45 |
| Test 2 | 105 | 1.2 | 50 |
| | Flame Speed at Barrier, ft/sec | | |
| Test 1 | 75 | | |
| Test 2 | 80 | | |

Both of these tests were successful in quenching the flame at the barrier site.

extent of our invention which is to be measured only by the claims which follow.

We claim:

1. An explosion suppression device comprising:

a closed container having a normally locked and openedly biased door for retaining an explosion suppression agent, said container having an ambient pressure responsive plate; and mechanical means for unlocking said door in response to a static pressure rise of as little as one pound per square inch increase in ambient gaseous pressure on said plate, whereby the suppression agent is released from the container.

2. The suppression device of claim 1 wherein said door is hinged and locked by a latch mechanism; and said mechanical means comprising said latch mechanism is operatively associated with the pressure responsive plate forming part of said closed container.

3. The device of claim 2 wherein said mechanical latch mechanism comprises a hook rigidly attached to said door, a pivoted clasp mount on said container to engage said hook, and a linking force transmitting member connected to said plate at one end and said clasp at the other end.

4. The device of claim 3 wherein said door is normally openedly biased by a spring attached to said container; and said linking member extends through said pressure responsive plate and is connected thereto.

5. The device of claim 1 wherein said pressure responsive plate is part of the top of said container and at least partially held to the remainder of the container by a collapsible bellows seal.

6. The device of claim 5 wherein said mechanical means comprises a hook attached to said door that engages a clasp attached to said container, said clasp being pivotally connected to a linking member which is movable in response to the movement of said pressure responsive plate.

7. The device of claim 1 wherein said normally locked door has a liquid tight seal around its inner perimeter where it engages the remainer of said container to provide for the retention of a liquid explosion suppression agent in the container.

8. An explosion suppression device comprising:

an explosion suppressant holding device pivotally mounted on one side;

a pressure sensitive diaphragm having an actuating rod attached thereto;

and a linking mechanism attached to said rod to normally maintain the holding device in a generally horizontal position until a predetermined pressure change causes the diaphragm to move its actuating rod and release the contents of the pivotally mounted explosion supressant holding device.

9. The device of claim 8 wherein said linking mechanism comprises a swivel clasp hook that normally engages an upper eye hook fixed to the roof of a mine.

* * * * *